US006889760B2

(12) United States Patent
Kluppel

(10) Patent No.: US 6,889,760 B2
(45) Date of Patent: May 10, 2005

(54) HEAT SHIELD

(75) Inventor: George E. Kluppel, Richmond, TX (US)

(73) Assignee: Hudson Products Corporation, Sugar Land, TX (US)

( * ) Notice: Subject to any disclaimer, the term of this patent is extended or adjusted under 35 U.S.C. 154(b) by 416 days.

(21) Appl. No.: 10/138,867

(22) Filed: May 3, 2002

(65) Prior Publication Data

US 2003/0205362 A1 Nov. 6, 2003

(51) Int. Cl.[7] ..... F27D 7/00

(52) U.S. Cl. ..... 165/176; 165/76; 165/95; 165/11.1

(58) Field of Search ..... 165/76, 95, 11.1, 165/176; 228/59

(56) References Cited

U.S. PATENT DOCUMENTS 4,170,010 A * 10/1979 Reed ..... 342/1
4,200,172 A 4/1980 Meuschke
4,526,311 A 7/1985 Schroder
4,535,727 A * 8/1985 Ziegler ..... 165/76
4,984,627 A 1/1991 LeBourgeois
4,986,343 A * 1/1991 Sing ..... 165/135
5,025,854 A 6/1991 Richter
2002/0139408 A1 * 10/2002 Mitzner ..... 135/115

FOREIGN PATENT DOCUMENTS

WO WO 92/00121 * 1/1992

* cited by examiner

*Primary Examiner*—Teresa J. Walberg
(74) *Attorney, Agent, or Firm*—Moser, Patterson & Sheridan

(57) ABSTRACT

A method and apparatus for protecting personnel required to work inside of a heat exchanger unit when the cooling air fan has been taken out service for maintenance or repair of the fan or other mechanical equipment, while hot fluid continues to flow through the heat exchanger tubes, and adjacent heat exchanger units continue to operate. An inflatable heat shield is inserted into the out of service heat exchanger unit, and inflated therein to block the convective heat generated by the hot fluid and the adjacent operating units from reaching the personnel working inside the heat exchanger unit.

46 Claims, 4 Drawing Sheets

HEAT SHIELD

BACKGROUND OF THE INVENTION

1. Field of the Invention

The present invention relates to air-cooled heat exchangers generally comprising a battery of heat exchanger units and more particularly to a novel shield to prevent convective heat from reaching personnel working within one of a battery of heat exchanger units that has been temporarily taken out of service for maintenance or repair during operation of the remaining units.

2. Description of the Prior Art

Air-cooled heat exchangers are widely used in the energy, chemical and manufacturing industries, and are generally referred to as direct system heat exchangers since they transfer heat from a fluid directly to ambient air.

Each air-cooled heat exchanger unit consists of a bundle of horizontally oriented tubes connected in parallel between fluid inlet and outlet headers. The outside of the tubes is formed with fins thereby increasing the air side surface so as to compensate for the low heat transfer coefficient of the cooling air. Each unit is equipped with at least one air-moving device which is normally an axial flow, propeller type fan that is located either above or below the tube bundle and causes the cooling air to flow generally upward and across the tube bundle in a direction that is approximately perpendicular to the orientation of the finned tubes. Fans that are located above the tube bundle pull the cooling air across the tube bundle and are referred to as induced draft fans. Fans that are located below the tube bundle push the cooling air across the tube bundle and are referred to as forced draft fans.

In air-cooled heat exchangers of this general type, and particularly where the fluid flowing through the tubes is steam, it is necessary to continually remove non-condensable gases from the outlet headers of the bundles. Otherwise, these gases will collect and form stagnant pockets in bundle tubes and headers which will freeze condensate in the winter and cause inefficient operation during the summer by blanketing heat transfer surfaces. Conventionally, non-condensable gases are so removed through vent condensers, dephlegmaters, or vent tubes connecting the bundle outlet headers with a common manifold generally leading to the first stage of a steam jet ejector or other suitable equipment.

During low steam load conditions and/or cold weather, the operator needs to reduce the quantity of cooling air through the bundles of the air-cooled heat exchanger. However, if this were to be done by merely shutting off certain fan motors while leaving others on, the resulting differences in steam flow rates pressure drops cause a dangerous and damaging condition in which the tubes of the bundles serviced by the operating fans would fill with non-condensable gases. To circumvent this, control procedures are recommended by the manufacturer for cyclically turning some fans on and others off as recited in a predetermined operating regimen of about 15 minutes duration for each cycle. The fan cycling is intended to scavenge the non-condensable gases from those tubes that have accumulated these gases while allowing the bundles serviced by the operating fans to fill with non-condensable gases once more. However, since all headers of conventional air-cooled heat exchangers of this type connect to a common manifold, these cyclic controls inherently interfere with operation of the system for removing non-condensable gases.

Some plant operators do not like to rely on a cyclic control system of this type because of its uncertainty, and hence it is the more common practice to place more reliance on equipment especially installed for controlling the amount of cooling air passing over the tubes of each bundle, such as by means of louvers, multi-speed fan motors, variable speed fan drives, variable pitch fan blades, or combinations of them. However, this added reliance increases the frequency of use of such equipment with a concomitant increase in the frequency of maintenance and repair of the equipment, most if not all of which is located within the air-cooled heat exchanger unit, thus requiring that maintenance personnel work within the unit and that the fan be taken out of service.

In air-cooled heat exchanger systems comprising a battery of air-cooled heat exchanger units arranged in side-by-side fashion with the tube bundles running parallel to one another, the cooling air flowing over the tube bundle absorbs the heat from the fluid flowing through the finned tubes and may be heated to temperatures of 200° F. or higher. Heat exchanger units equipped with induced draft fans are generally limited to applications where the temperature of the air exiting the tube bundle does not exceed 220° F. so as not to damage the fan blades, bearings, or other mechanical equipment located in the path of the heated air. Heat exchanger units equipped with forced draft fans are generally recommended where the air temperature exiting the tube bundle exceeds the limit set for units equipped with induced draft fans and particularly where such exiting air temperatures may exceed 350° F. due to low air flow operation or the shut down of the fan. The cooling air will normally enter from beneath the heat exchanger unit and exit, as heated air, from the top of the unit. This airflow pattern results in a lower air pressure area directly under the heat exchanger and a higher pressure area directly above it. Thus, whenever the fan is shut down in a heat exchanger unit that is being taken out of service for maintenance or repair on the fan or other mechanical equipment located within the unit, this differential in air pressure will cause some of the heated air exiting from the adjacent operating heat exchanger units to be drawn over and across the tube bundle of the unit which has been taken out of service. Furthermore, even though the fan has been shut down, it is desirable and normal practice to keep the hot fluid flowing through the finned tubes of the bundle located in the unit that has been taken out of service. However, such practice adds further heat to the already heated air that is being drawn down from the adjacent operating heat exchanger units. This heated air creates a very harsh environment for maintenance personnel if they should have to work within the heat exchanger unit that has been taken out of service.

Heretofore, relief for maintenance personnel required to work within an out of service heat exchanger unit has been in the form of portable fans which blow fresh air into the work area, and plywood boards placed on top of the tube bundle in units equipped with induced draft fans, and on top of the fan guard in units equipped with forced draft fans, in an attempt to block the heat generated by the hot fluid flowing through the tubes of the bundle and the heated air being drawn from the adjacent operating heat exchanger units. This arrangement has proven less than satisfactory since the plywood boards manage, at best, only to deflect rather than to prevent the heated air from being drawn into the work area.

SUMMARY OF THE INVENTION

Generally, the air-cooled heat exchanger unit addressed by this invention is one of a battery of like units that comprises an air-cooled heat exchanger system. Each air-cooled heat exchanger unit includes a hot fluid conveying tube bundle, at least one fan for causing cooling air to pass over the tube bundle, and a plenum chamber whose interior defines a passageway for the cooling air.

When the fan of a heat exchanger unit is taken out of service for maintenance or repair of the fan or other mechanical equipment, maintenance personnel will be required to work inside the plenum chamber of the unit even though hot fluid is flowing through the tube bundle of the out of service unit while the other units, including those adjacent to the out of service unit, continue to operate. The convective heat generated by the hot fluid and the adjacent operating heat exchanger units is capable of creating a very harsh working environment inside the plenum chamber of the out of service unit, and thus there is a need to prevent such environment from reaching maintenance personnel working inside the out of service unit's plenum chamber.

This invention addresses the aforementioned need by providing a protective means for shielding maintenance personnel working within the air-cooled heat exchanger unit when the fan is taken out of service. The protective means comprising a gathered inflatable heat shield capable of fitting into the plenum in a deflated state, air pressure means for inflating the gathered heat shield, and the inflated heat shield being of sufficient size to block the convective heat from reaching the maintenance personnel working inside the heat exchanger.

One type of an air-cooled heat exchanger has at least a portion of the fan, including propeller type blades, located above the tube bundle, and a plenum chamber, also located above the tube bundle. In this embodiment of the invention, when in use, the inflated heat shield is situated above of the tube bundle.

Another type of an air-cooled heat exchanger has the fan equipped with a guard and located below the fan, and a plenum chamber, also located below the tube bundle. In this embodiment of the invention, when in use, the inflated heat shield is situated beneath the tube bundle.

The air pressure means for inflating the heat shield includes a blower, means for supplying pressurized air to inflate heat shield. Preferably, the shield is inflated at a pressure of approximately 40 psig, although a much wider range of pressures can suffice.

The inflated heat shield is preferably made of very light non-porous resilient fabric which is woven to be rip-stop, such that a tear will not propagate in the fabric. The fabric must be of high strength and resist ripping and tearing and be able to withstand temperatures of up to 300° F.

The heat shield includes zipper closure means which, when opened, provides a cooling air source for maintenance personnel working in the heat exchanger plenum chamber, and may also be used to speed up the deflation of the heat shield once the maintenance personnel have completed their work and prior to the removal of the heat shield from the plenum chamber. The heat shield may include vent ports to augment the flow of cooling air to the plenum chamber, and to accelerate the deflation of the heat shield.

In accordance with the invention, when the fan of an air-cooled heat exchanger unit is taken out of service for maintenance or repair of the fan or other mechanical equipment, the gathered inflatable heat shield is inserted into the plenum chamber. In the case of a unit equipped with an induced draft fan, the gathered heat shield is unfolded and spread on top of the hot fluid conveying tube bundle, whereas in the case of a unit equipped with a forced draft fan, the gathered heat shield is unfolded and spread above the fan. In both cases, the inflating air pressure is ideally maintained around 40 psig, with the shield being located above the bundles in an induced draft exchanger and beneath the bundles in a forced draft exchanger. Ultimately, those skilled in the art will readily adapt the pressure, shield positioning and the inflation methodology to suit the particular needs of any given heat exchanger.

BRIEF DESCRIPTION OF THE DRAWINGS

Preferred embodiments of the invention are shown in the drawings wherein.

DESCRIPTION OF THE PREFERRED EMBODIMENTS

Figure 1:
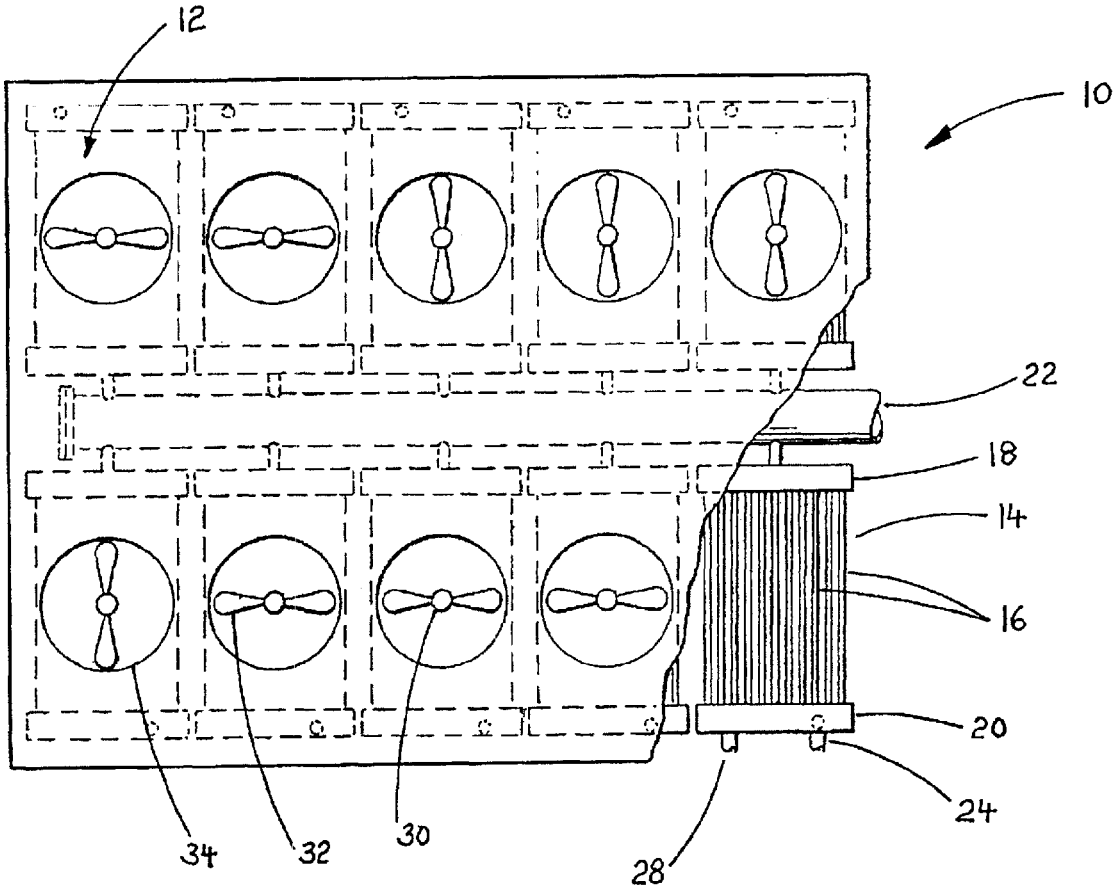
FIG. 1 is a diagrammatic plan view of an air-cooled heat exchanger system comprised of a battery of side-by-side air-cooled heat exchanger units.

Referring to FIGS. 1 through 8, the same reference numerals are used to designate functionally similar parts.

Referring to FIG. 1, there is shown an air cooled heat exchanger system 10 comprised of ten heat exchanger units 12, each having a tube bundle 14, and all tube bundles being arranged on generally the same level. As shown, each bundle 14 includes a plurality of tubes 16 and has an inlet header 18 at one end and an outlet header 20 at the other end. A hot fluid such as steam from a turbine exhaust is introduced into the inlet header 18 of each tube bundle 14 through a common manifold header 22 and is removed from the outlet header 20 of each tube bundle 14 through a drain line 24. The heat exchanger 12 of FIG. 1 is equipped with an induced draft fan 30 having propeller type blades 32 located within a shroud 34.

Referring to FIGS. 2 through 5, the air-cooled heat exchanger unit 12 is shown having a support structure 13 and including a plenum chamber 36 whose interior defines an airflow passageway 37. The plenum chamber 36 may include a hatch 38 to provide access to the passageway 37.

Figure 2:
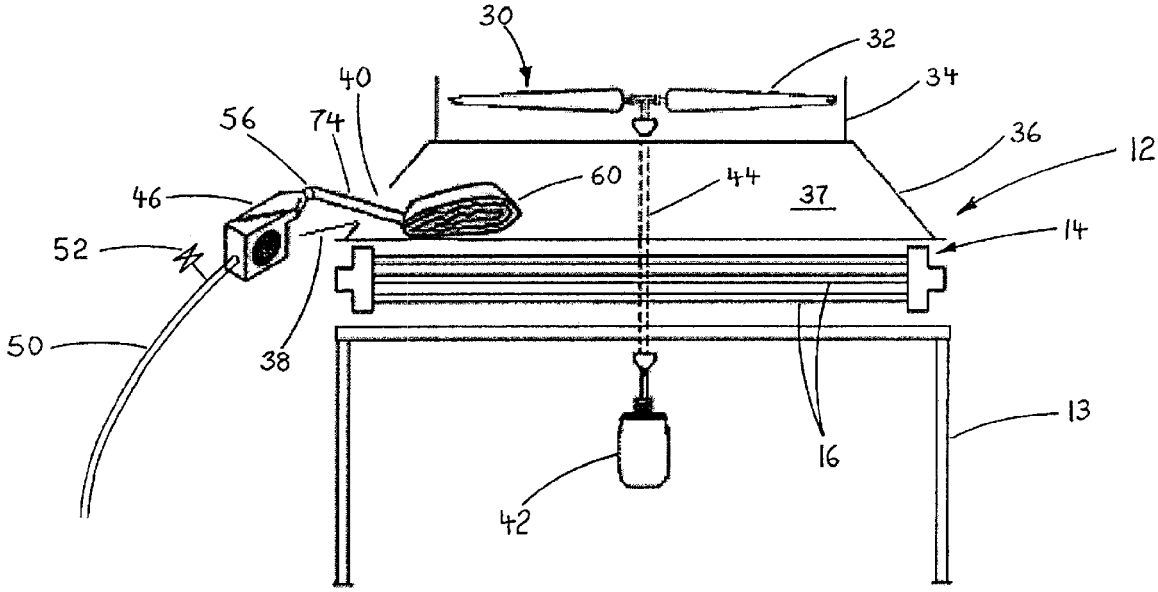
FIG. 2 is a cross sectional side elevation of an air-cooled heat exchanger unit equipped with an induced draft fan, and illustrating the heat shield gathered on top of the tube bundle in an un-inflated condition.
Figure 3:
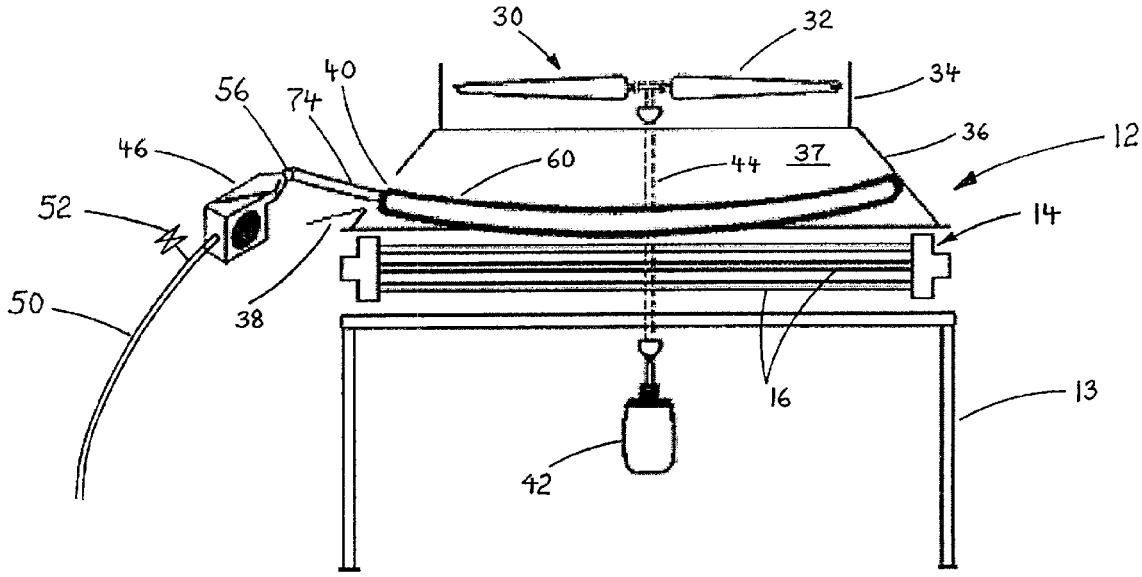
FIG. 3 is a view of the heat exchanger unit illustrated in FIG. 1 after the gathered heat shield has been inflated.

Referring to FIGS. 2 and 3, the plenum chamber 36 is shown located above the tube bundle 14 of heat exchanger unit 12, and the latter is equipped with an induced draft fan 30 having propeller type blades 32 located within a shroud 34. At least a portion of the fan 30, including the blades 32 and the shroud 34, is located above the plenum chamber 36 so as to draw cooling air past the hot fluid conveying tubes 16 of the bundle 14. The fan 30 is driven by a motor 42 connected with the fan blades 32 through a drive shaft 44.

Figure 4:
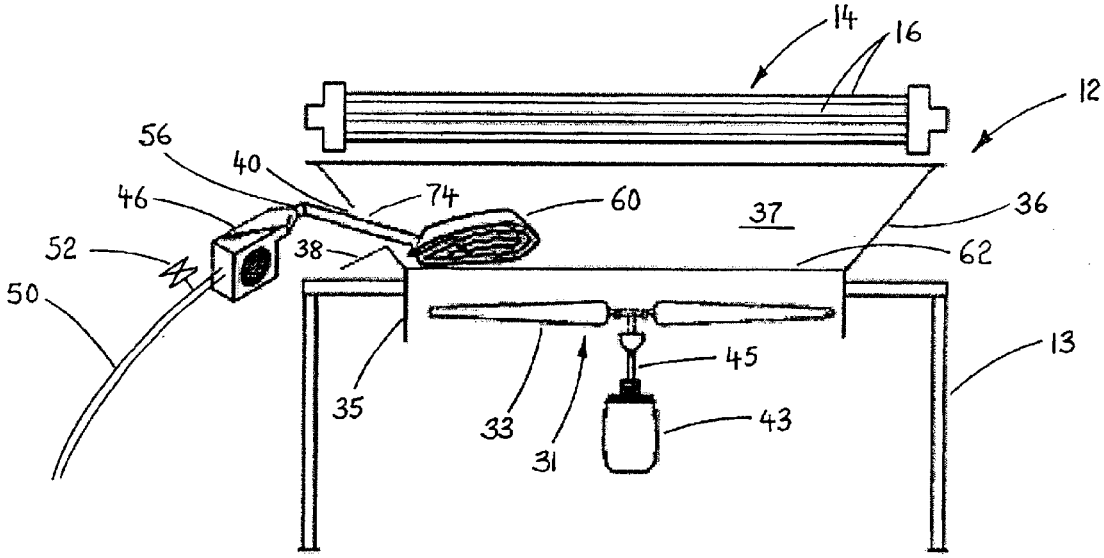
FIG. 4 is a cross sectional side elevation of an air-cooled heat exchanger unit equipped with a forced draft fan, and illustrating the heat shield gathered on top of the fan guard in an un-inflated condition.
Figure 5:
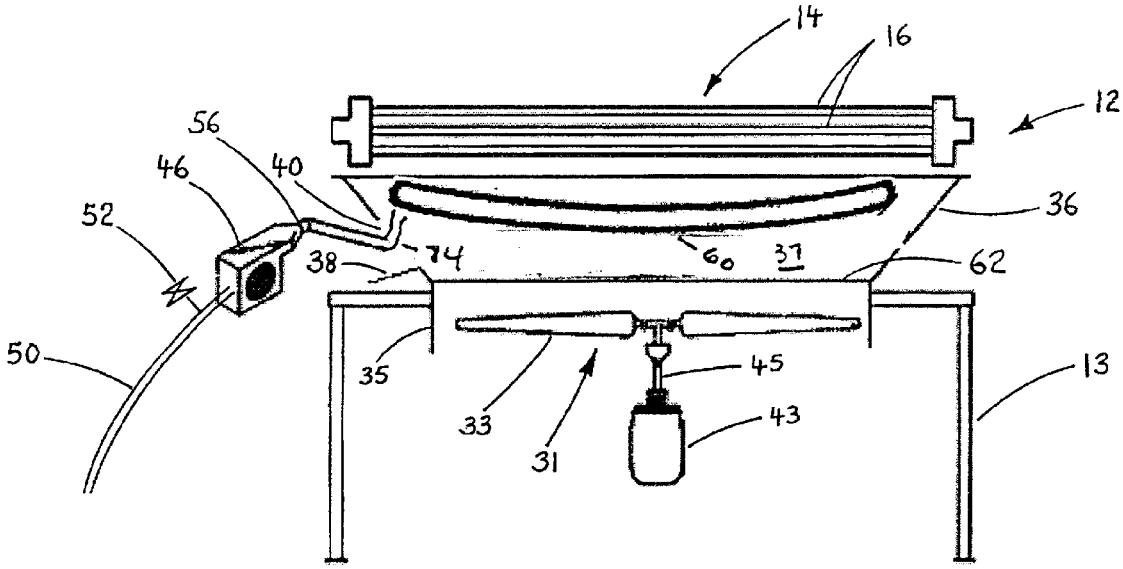
FIG. 5 is a view of the heat exchanger unit illustrated in FIG. 4 after the gathered heat shield has been inflated.

Referring to FIGS. 4 and 5, the plenum chamber 36 is shown located below the tube bundle 14 of heat exchanger 12, and the latter is equipped with a forced draft fan 31 located below the plenum chamber 36 and having propeller type blades 33 encircled by a shroud 35 to force cooling air past the hot fluid conveying tubes 16 of the bundle 14. The fan 31 is driven by a motor 43 connected with the fan blades 33 through a drive shaft 45. A fan guard 62 is provided above the propeller type blades 33.

Referring to FIGS. 2 through 5, there is shown a centrifugal type blower 46 which is typically pneumatically or electrically operated, and is capable of moving air at a pressure from one inch to nine inches of water column. Means for supplying compressed air can include a conduit 50 equipped with a regulator 52 located in close proximity to the blower 46 to control the blower discharge pressure, although those skilled in the art can utilize and suitable method or apparatus for inflating the shield. One of the conduits 74 extending from the inflatable heat shield 60 is connected to the discharge end 56 of blower 46. An extension conduit, not shown, will be used where the blower discharge end 56 and the conduit 74 are too far apart to be connected directly to one another.

Referring to FIGS. 2 and 4, the heat shield 60 is shown in a gathered inflatable condition. The gathering of the heat shield 60 is accomplished by rolling or folding the shield onto itself and, thus, sizing it to into the plenum 36 in its gathered inflatable condition. Referring to FIG. 2, in particular, the gathered heat shield 60 is shown laying on top of the tube bundle 14 as is the case for an air-cooled heat exchanger 12 equipped with an induced draft fan 30. Referring to FIG. 4, in particular, the gathered heat shield 60 is shown laying on top of the fan guard 62 as is the case for an air-cooled heat exchanger 12 equipped with a forced draft fan 31.

Referring to FIGS. 3 and 5, the heat shield 60 is shown in its inflated condition. The heat shield 60 is normally sized to accommodate, in its inflated condition, the largest plenum chamber in a given plant location, and since the heat shield 60 is made of very light and resilient fabric it will perform just as well in smaller plenum chambers without having to be resized. Referring to FIG. 3, in particular, the inflated heat shield 60 is shown as lying on top of the tube bundle 14 to block the convective heat generated by the hot fluid flowing through the tubes 16 of the bundle 14 from rising into the plenum chamber 36 when the induced draft fan 30 is taken out of service and maintenance personnel are required to work on the fan 30 or other mechanical equipment located inside the plenum chamber 36. Moreover, if the air-cooled heat exchanger unit 12 is one of a battery of operating heat exchangers, the inflated heat shield 60 acts as a seal between the lower air pressure directly below the heat exchanger unit 12 and the higher air directly above it and, thus, prevents the heated air exiting the adjacent operating heat exchanger units from being drawn into the unit whose fan has been taken out of service.

Referring to FIG. 5, in particular, the inflated heat shield is situated above the fan guard 62 of the forced draft fan 31 which has been taken out of service. In this arrangement, the inflated heat shield 60 blocks the convective heat generated by the hot fluid flowing through the tubes 16 from reaching the maintenance personnel working on the fan or other mechanical equipment located below the fan guard 62. Moreover, if the air-cooled heat exchanger unit 12 is one of a battery of heat exchanger units, the inflated heat shield 60 will act as a seal and, thus, prevent the heated air exiting the adjacent operating heat exchanger units from being drawn into the unit whose fan has been taken out of service.

Figure 6:
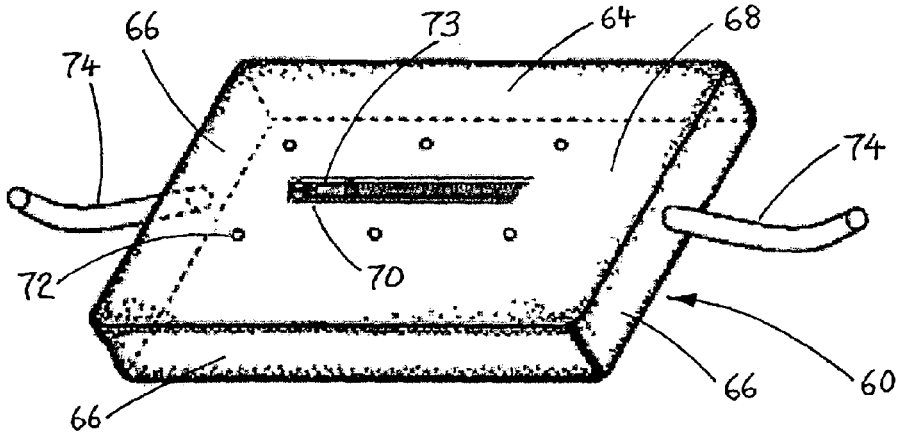
FIG. 6 is a perspective view of an inflated heat shield.
Figure 7:
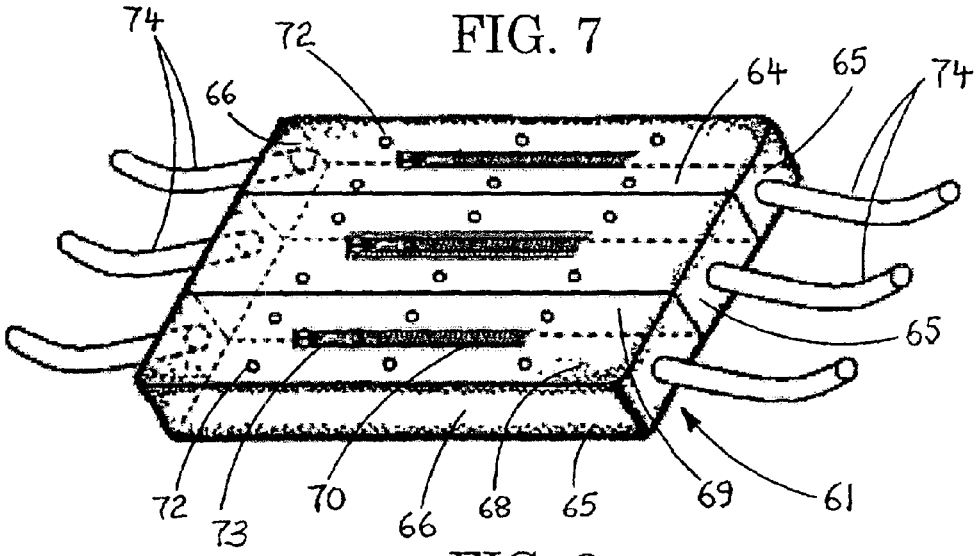
FIG. 7 is a perspective view of an alternate embodiment of an inflated heat shield.
Figure 8:
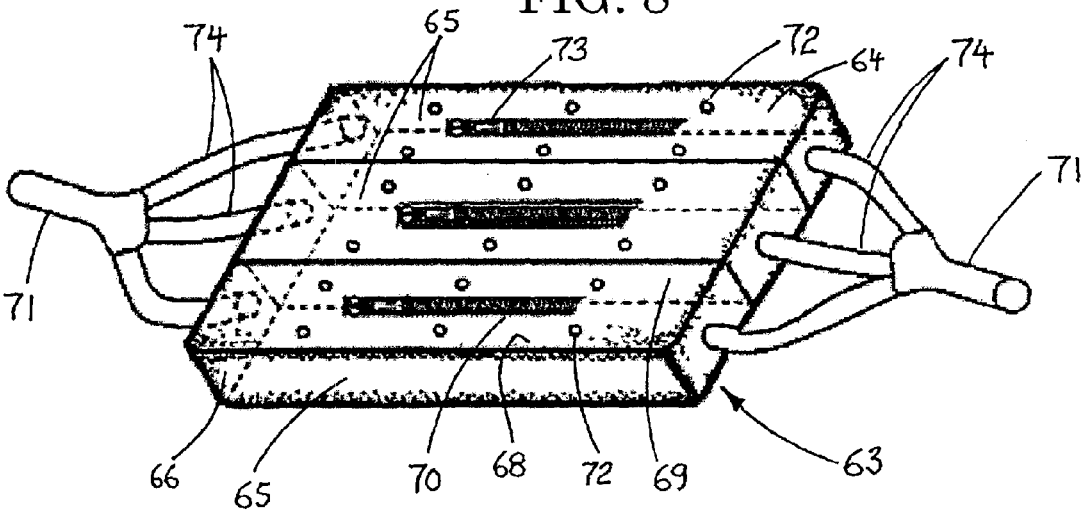
FIG. 8 is a perspective view of another alternate embodiment of an inflated heat shield.

Referring to FIGS. 6 through 8, there is shown an inflated heat shield 60 defined by a top wall 64, sidewalls 66, and a bottom wall 68. The heat shield 60 is formed of a very light, high strength, and resilient fabric woven to be rip-stop, for example, the rip-stop nylon used to fabricate the envelope of a hot air balloon. Just as with the envelope of a hot air balloon, the interior of the heat shield 60 is usually coated with polyurethane to make it non-porous and may also be provided with insulation comprising a fibrous structure of nonflammable heat set carbonaceous materials to enable it to withstand temperatures of 300° F. and above for longer periods of time.

Referring to FIG. 6, in particular, the top wall 64 of the inflated heat shield 60 includes a zipper closure device 70 with a pull tab 73 and two conduits 74 communicating with the interior of the heat shield 60 through one set of opposing sidewalls 66. The conduits 74 may be formed as part of the heat shield fabric or be separate conduits permanently or detachably connected to the heat shield 60. Vent ports 72 are an optional means for preventing over-inflation.

Referring to FIG. 7, in particular, there is shown an alternate inflated heat shield 61 that is divided by partition walls 69 into individual compartments 65, in this case, two partition walls 69 form three such compartments 65 which are selectively inflatable and deflatable through conduits 74, with each of the compartments 65 being fitted with or accommodating the connection of a conduit 74 at its opposite ends. Each compartment 65 includes a zipper closure device 70 with a pull tab 73. Again, vent ports 72 can prevent over-inflation.

Referring to FIG. 8, in particular, there is shown another inflated heat shield 63 having three individual compartments 65 separated by partition walls 69 and including zipper closure devices 70 with pull tabs 73 and optional vent ports 72, and wherein the conduits 74 which extend from adjacent ends of the compartments 65 connect to a manifold 71, such that the compartments 65 are simultaneously inflatable or deflatable.

The installation of the inflatable heat shield will be described with general reference to FIGS. 1 through 8, and particularly with the heat shield 60 shown in FIG. 6. When the induced draft fan 30 of a heat exchanger unit 12 is taken out of service for maintenance of the fan or other mechanical equipment, the gathered inflatable heat shield 60 is inserted into the plenum 36. The gathered inflatable heat shield is spread on top of the hot fluid conveying tube bundle 14 with the zipper closure device 70 and the vent ports 72 facing up into the passageway 37. In case of a unit equipped with a forced draft fan 31, the gathered inflatable heat shield 60 is spread on top of the fan guard 62 with the zipper closure device 70 and the vent ports 72 facing the fan guard 62. In both cases, the inflatable heat shield conduit 74 is connected to the discharge end 56 of the blower 46 while the other conduit 74 is closed by tying a knot near its open end. The zipper closure devices 70 and the vent ports 72 should be closed while the heat shield 60 is being inflated. The closure means, not shown, for the vent ports 72 may be in the form of zippered or button-down flaps which can, along with the zipper closure device 70, be selectively opened later to act as a source of cooling air while maintenance personnel are working inside the heat exchanger unit 12. The inflating air pressure is preferably maintained around 40 psig and also while the heat shield is in use; however various pressures, shield positions and inflation methods may be used without deviating from the principles of invention. Following the completion of the work inside the heat exchanger unit 12, the heat shield 60 is deflated by shutting off the blower 46, disconnecting the conduit 74 from the blower 46, removing the knot from the other conduit 74, and fully opening the zipper closure device 70 and the vent ports 72. The inflating of the compartments 65 of the heat shield 61 shown in FIG. 7 requires either three blowers or the sequential use of one blower, whereas the inflating of the compartments 65 of the heat shield 63 shown in FIG. 8 is simultaneous and is accomplished through the manifold 71.

Although this invention has been described above with reference to particular means, materials and embodiments, it is to be understood that the invention is not limited to these disclosed particulars, but extends instead to all equivalents within the scope of the following claims.

I claim:

1. In an air-cooled heat exchanger combination having a hot fluid conveying tube bundle, at least one fan for causing cooling air to pass over the tube bundle, and a plenum chamber defining a passageway for the cooling air, a protective means for shielding maintenance personnel from convective heat while inside the plenum, comprising, an inflatable bag sized to fit into the plenum chamber, wherein the bag is of sufficient size to block convective heat within the plenum; and air pressure means for inflating the bag.

2. The combination as recited in claim 1, wherein the bag is situated in the plenum chamber above the tube bundle.

3. The combination as recited in claim 2, wherein at least a portion of the fan is located above the tube bundle and wherein the inflated bag rests directly on top of the tube bundle.

4. The combination as recited in claim 1, wherein the bag is situated in the plenum chamber beneath the tube bundle.

5. The combination as recited in claim 4, wherein the fan is located beneath the tube bundle and wherein the inflated bag blocks a portion of the plenum chamber defined by the fan on one end and the tube bundle on an opposite end.

6. The combination as recited in claim 1, wherein the air pressure means comprises a blower and conduit means connecting the air outlet to the heat shield.

7. The combination as recited in claim 6, wherein the air pressure means further comprises a regulator operatively connected to the conduit means for controlling the pressure of the air delivered by the air pressure means to inflate the heat shield.

8. The combination as recited in claim 1, wherein the bag is defined by a top wall, sidewalls, and a bottom wall, all of the walls being formed of a substantially nonporous, resilient fabric.

9. The combination as recited in claim 8, wherein the fabric is woven to be rip-stop.

10. The combination as recited in claim 9, wherein the bag includes a second conduit which communicates with the air pressure means.

11. The combination as recited in claim 10, wherein the bag includes zipper closure means.

12. The combination as recited in claim 11, wherein the bag includes vent means.

13. The combination as recited in claim 8, wherein the fabric is woven to be rip-stop.

14. The combination as recited in claim 1, wherein the bag includes a second conduit which communicates with the air pressure means.

15. The combination as recited in claim 1, wherein the bag includes zipper closure means.

16. The combination as recited in claim 1, wherein the bag includes vent means.

17. A method of enabling maintenance personnel to service one heat exchanger unit in a battery of operational heat exchanger units wherein each heat exchanger unit has a hot fluid conveying tube bundle, at least one fan for causing cooling air to pass over the tube bundle, and a plenum chamber defining a passageway for the cooling air, the method comprising the steps of:

(a) identifying the heat exchanger unit in need of service and disabling the fan associated therewith;

(b) subsequently inserting an inflatable bag into the plenum; and (c) providing a source of pressurized inflating air and inflating the bag to block convective heat from the hot fluid conveyed by the tube bundle and the adjacent operating units from reaching maintenance personnel working in the plenum chamber.

18. The method as recited in claim 17, wherein the bag is situated in the plenum chamber above the tube bundle.

19. The method as recited in claim 18, wherein at least a portion of the fan is located above the tube bundle and wherein the inflated bag is positioned to rest directly on top of the tube bundle.

20. The method as recited in claim 17, wherein the fan is located beneath the tube bundle, wherein the bag is positioned in the plenum chamber beneath the tube bundle, and wherein the inflated bag blocks a portion of the plenum chamber defined by the fan on one end and the tube bundle on an opposite end.

21. The method as recited in claim 17, wherein the bag is inflated to a pressure of approximately 40 psig.

22. The method as recited in claim 17, wherein the bag is provided with a vent and further comprising the step of selectively opening the vent to allow inflating air to flow from the bag into the passageway thereby acting as a coolant.

23. An inflatable service platform for performing maintenance work on an air-cooled heat exchanger having a hot fluid conveying tube bundle, at least one fan for causing cooling air to pass over the tube bundle, and a plenum chamber defining a passageway for the cooling air; a protective means for shielding maintenance personnel from convective heat while inside the plenum, the platform comprising:

an inflatable member constructed from a substantially non-porous, resilient fabric in order to form a flat, planar surface when inflated;

an inlet for admitting air into the member, the inlet being operatively associated with a source for inflation air; and vent means for releasing air from the member.

24. The platform as recited in claim 23, wherein there are a plurality of inflatable members and wherein each member is physically attached to another to form a substantially flat, planar surface.

25. The platform as recited in claim 24, wherein there are a plurality of inlets and wherein each inlet is operatively associated with an individual member in order to permit air to be delivered separately to the individual members.

26. The platform as recited in claim 25, wherein each inlet is operatively associated with a differing source for inflation air.

27. The platform as recited in claim 24, wherein there are a plurality of vents and wherein each vent is operatively associated with an individual member in order to permit air to be released separately from the individual members.

28. The platform as recited in claim 23, wherein the vent is positioned to release air in order to cool and protect the platform from external conditions.

29. The platform as recited in claim 23, wherein the fabric is woven to be rip-stop.

30. A heat blocking member for use in a heat exchanger unit, comprising an inflatable member capable of fitting into a plenum chamber of the heat exchanger unit and blocking heat within the plenum chamber when inflated.

31. The heat blocking member of claim 30, further comprising an air pressure supply member for inflating the inflatable member.

32. The heat blocking member of claim 30, wherein the inflatable member comprises an inflatable bag.

33. The heat blocking member of claim 30, wherein the heat exchanger unit comprises a hot fluid conveying tube bundle, and the heat blocking member is located in the plenum chamber above the tube bundle.

34. The heat blocking member of claim 30, wherein the heat exchanger unit is air-cooled.

35. The heat blocking member of claim 30, wherein the heat exchanger unit comprises a hot fluid conveying tube bundle, and the heat blocking member is located in the plenum chamber below the tube bundle.

36. The heat blocking member of claim 30, wherein the inflatable member is formed from a substantially nonporous, resilient material.

37. The heat blocking member of claim 30, wherein the heat blocked by the heat blocking member is convective heat.

38. A method of blocking heat in a plenum chamber of a heat exchanger unit, comprising:

providing a heat blocking member within the plenum chamber, the heat blocking member inflatable by pressurized air;

inflating the heat blocking member using pressurized air; and blocking heat from the heat exchanger unit in the plenum chamber using the inflatable member.

39. The method of claim 38, wherein the heat is convective heat.

40. The method of claim 38, further comprising blocking heat from one or more additional heat exchanger units adjacent to the heat exchanger unit in the plenum chamber using the inflatable member.

41. The method of claim 38, wherein blocking heat from the heat exchanger unit comprises blocking heat from hot fluid conveyed by a tube bundle portion of the heat exchanger unit.

42. The method of claim 38, further comprising providing a source of pressurized air for inflating the heat blocking member using pressurized air.

43. The method of claim 38, further comprising selectively releasing the pressurized air from the heat blocking member.

44. The method of claim 43, wherein the inflatable member comprises a venting member which permits releasing of the pressurized air from the heat blocking member.

45. The method of claim 38, further comprising:

providing a second heat blocking member within a second heat exchanger unit, the second heat exchanger unit located adjacent to the heat exchanger unit and having a second plenum chamber; and selectively inflating the heat blocking member and the second heat blocking member with pressurized air to selectively block heat in the plenum chamber and the second plenum chamber, respectively.

46. The method of claim 45, further comprising selectively releasing pressurized air from the heat blocking member and the second heat blocking member to allow the pressurized air to act as a coolant.

* * * * *